US010323899B2

(12) United States Patent
Missbach et al.

(10) Patent No.: US 10,323,899 B2
(45) Date of Patent: Jun. 18, 2019

(54) TENSIONING DEVICE FOR A CROSSBOW, AND CROSSBOW COMPRISING SUCH A TENSIONING DEVICE

(71) Applicants: Gerald Missbach, Vienna (AT); Harald Jursitzky, Mitterndorf an der Fischa (AT)

(72) Inventors: Gerald Missbach, Vienna (AT); Harald Jursitzky, Mitterndorf an der Fischa (AT)

( * ) Notice: Subject to any disclaimer, the term of this patent is extended or adjusted under 35 U.S.C. 154(b) by 0 days.

(21) Appl. No.: 16/307,834

(22) PCT Filed: Jul. 20, 2017

(86) PCT No.: PCT/AT2017/060180
§ 371 (c)(1),
(2) Date: Dec. 6, 2018

(87) PCT Pub. No.: WO2018/014062
PCT Pub. Date: Jan. 25, 2018

(65) Prior Publication Data

US 2019/0128637 A1 May 2, 2019

(30) Foreign Application Priority Data

Jul. 20, 2016 (AT) ..... A 50658/2016

(51) Int. Cl.
*F41B 5/12* (2006.01)
*F41B 5/14* (2006.01)

(52) U.S. Cl.
CPC ..... *F41B 5/1449* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 3,028,851 A 4/1962 Drake
3,913,556 A * 10/1975 Palma ..... F41B 5/0031 124/23.1

(Continued)

FOREIGN PATENT DOCUMENTS

CN 103353257 A 10/2013
DE 43 375 34 A1 5/1995

(Continued)

OTHER PUBLICATIONS

International Search Report of PCT/AT2017/060180, dated Sep. 25, 2017.

(Continued)

*Primary Examiner* — John A Ricci
(74) *Attorney, Agent, or Firm* — Collard & Roe, P.C.

(57) ABSTRACT

A tensioning device for a crossbow or the like, such as a harpoon, a line throwing device, a toy crossbow, a pistol crossbow, a spear thrower, or a ballista, includes a shaft and limbs connected thereto. A connection element designed to connect to the shaft of the crossbow has securing devices for rotatably or pivotally securing the limbs. The connection element is connected to at least one drive device which can be connected to the limbs and by which the limbs can be converted rotatably or pivotally from a first position, in which the limbs form a first angle together with the shaft, into a second position, in which the limbs form a second angle together with the shaft, wherein the second angle is larger than the first angle, in order to convert the limbs and a bowstring connected thereto from a non-tensioned position into a tensioned shoot-ready position.

15 Claims, 8 Drawing Sheets

(56) References Cited

U.S. PATENT DOCUMENTS

| | | | | |
|---|---|---|---|---|
| 5,445,139 | A * | 8/1995 | Bybee | F41B 5/12 124/23.1 |
| 5,749,348 | A * | 5/1998 | Oviedo-Reyes | F41B 5/12 124/25 |
| 5,931,145 | A * | 8/1999 | Oviedo-Reyes | F41B 5/12 124/20.3 |
| 5,931,146 | A * | 8/1999 | Schrader | F41B 5/10 124/23.1 |
| 6,868,845 | B1 | 3/2005 | Moore | |

FOREIGN PATENT DOCUMENTS

| | | | |
|---|---|---|---|
| WO | 01/92808 | A1 | 12/2001 |
| WO | 2009/112902 | A1 | 9/2009 |

OTHER PUBLICATIONS

Austrian Search Report in A 50658/2016-1, dated Feb. 27, 2017, with English translation of relevant parts.
Written Report of International Search Authority in PCT/AT2017/060180, dated Jan. 25, 2018, with English translation of relevant parts.

* cited by examiner

TENSIONING DEVICE FOR A CROSSBOW, AND CROSSBOW COMPRISING SUCH A TENSIONING DEVICE

CROSS REFERENCE TO RELATED APPLICATIONS

This application is the National Stage of PCT/AT2017/060180 filed on Jul. 20, 2017, which claims priority under 35 U.S.C. § 119 of Austrian Application No. A 50658/2016 filed on Jul. 20, 2016, the disclosure of which is incorporated by reference. The international application under PCT article 21(2) was not published in English.

The invention relates to a tensioning device for a crossbow or the like such as for example a harpoon, a line throwing device, a toy crossbow, a pistol crossbow, a spear thrower or a ballista, comprising a shaft and limbs connected thereto, wherein a connection element is provided, which is designed to connect to the shaft of the crossbow and which comprises securing devices for rotatably or pivotally securing the limbs.

The invention further relates to a crossbow with a shaft extending in shooting direction for receiving a projectile, in particular an arrow or a roundball and with two limbs rotatably or pivotally connected to the shaft, to which limbs a bowstring is connected provided for engaging with the projectile.

Crossbows are well known from the state of the art and are used both in the field of sports and for hunting. In contrast to bows, in which initially an arrow is brought into engagement with a bowstring and the limbs of the bow are then tensioned by the effort of the shooter, with the crossbow the limbs are initially tensioned by pulling back the associated bowstring followed by a projectile such as an arrow being brought into engagement with the bowstring. The limbs are tensioned either exclusively by the effort of the shooter with the support of tensioning devices such as tensioning levers or winches or exclusively by tensioning devices, which for example move the limbs in longitudinal direction of the crossbow relative to a triggering device or relative to a shoulder support. The disadvantage is that tensioning takes up a relatively large amount of time so that the shooting sequence which can be achieved is very low.

The WO 01/92808 A1 has revealed a crossbow which can be motorically tensioned and which comprises a battery-operated electric motor which is connected to a threaded rod. This threaded rod moves a trigger block engaging in the bowstring to be tensioned along the crossbow. Pivotal limbs are fastened to the main body of the crossbow, thereby permitting space-saving transport or space-saving storage. The construction from a mechanical point of view is relatively complex.

The CN 103353257A discloses a collapsible bow with adjustable tension. To this end the bow comprises pivotally mounted arms, the position of which can be adjusted by means of at least one longitudinally adjustable device such as by a reciprocating piston, as a result of which the tension of the bowstring can be varied.

The disadvantage with known crossbows consists in that the tensioning operation is time-consuming and, with simply constructed models, requires a lot of effort. Often, the shooter has to leave his horizontal position in order to tension the crossbow, wherein tensile forces of up to 150 kg are required, which is not unusual. Manual tensioning operations may require more than 30 seconds and are cumbersome, in particular when levers or winches are to be operated. Even with electrical drive devices for tensioning the limbs of the crossbow the tensioning operation often takes too long in order to achieve a sufficiently high shooting sequence and to fire a second shot at a moving target. Moreover such crossbows are often heavy and unwieldy.

It is the requirement of the present invention to propose a tensioning device as mentioned above for a crossbow or similar device, which permits quick and preferably low-noise tensioning of the crossbow without any physical effort by the shooter. In particular there shall be no, or hardly any, need for a change in shooting position or body posture on the part of the shooter. Moreover the tensioning device shall permit a compact transport of the crossbow, wherein it shall be possible for the crossbow to be converted without a tool from a space-saving transport position into a shoot-ready position. Implementation of the design shall be as simple as possible, robust and low-cost. The tensioning device shall preferably be suitable for retro-fitting to existing crossbows, but shall also be able to be integrated into respectively developed crossbows. Disadvantages of known tensioning devices shall be avoided or at least reduced.

The requirement of the present invention also consists in proposing an above-mentioned crossbow which comprises the advantages mentioned in connection with the tensioning device.

The requirement according to the invention with regard to the tensioning device is met in that the connection element is connected to at least one drive device connectable to the limbs, with which drive device the limbs can be rotatably or pivotally moved from a first position, in which the limbs form a first angle together with the shaft, into a second position, in which the limbs form a second angle together with the shaft, wherein the second angle is larger than the first angle in order to move the limbs and a bowstring attached thereto from a non-tensioned position into a tensioned shoot-ready position. The tensioning device according to the invention is thus provided for being arranged on a crossbow or a similar device such as a harpoon, a line throwing device, a toy crossbow, pistol crossbow, spear thrower (ballista). The crossbow comprises a shaft known as such which is designed for receiving and guiding a projectile to be fired, in particular an arrow. The shaft extends in longitudinal direction, i.e. in the intended shooting direction of the crossbow and is connected to two limbs at, or close to, one end facing away from the shooter when the crossbow is in the operative position. During the tensioning operation the two limbs are elastically deformed or bent in order to, in this way, generally store therein that amount of energy which is intended for accelerating the projectile. With known crossbows the limbs are usually fixedly connected to the shaft. By contrast a connection element is provided which comprises securing devices (attachment devices) for securing (attaching) the limbs in a rotatable or pivotable manner. Preferably a securing device is provided for each of the limbs. The limbs may be rotatably received for example, in a respective borehole of a securing device by means a spigot attached to the limbs, while the securing device is fixedly connected to the connection element. The connection element itself is arranged for being connected to, or is connected to, the shaft of the crossbow. For example the connection element may be screwed to the shaft. In order to enable the limbs to be tensioned via the bowstring connected thereto without the shooter or user of the crossbow making a physical effort, at least one drive device is provided by the invention, which is connected to the connection element and which may also be or is connected to the limbs. In the case of a securing device fixedly connected to the connection element the drive device may be directly connected to the limbs, in order to pivot the same. In particular the drive device is configured to pivot the rotatable limbs received in the securing device from a first position, in which the limbs form a first angle together with the shaft, into a second position, in which the limbs form a second angle together with the shaft. With this arrangement the second angle is larger than the first angle, wherein both angles between the limbs and the shaft are viewed in direction of the end of the shaft facing the shooter. When the limbs assume the first angle to the shaft, the limbs and the bowstring connected thereto are in a non-tensioned position, in which the shooter, basically without physical effort, i.e. without having to tension the crossbow/to deform the limbs, is able to bring the bowstring into engagement with a triggering device of the crossbow. In this position the limbs and the bowstring are not tensioned. When however, the limbs assume the second angle to the shaft, the limbs and the bowstring connected thereto are in a shoot-ready, tensioned position, in which the energy required for accelerating the projectile is stored in the limbs. By actuating the triggering device the function of which is known from known crossbows, the bowstring is released and the projectile is accelerated in shooting direction. The drive device thus executes the rotating or pivoting movement of the limbs from the non-tensioned position, in which the bowstring is brought into engagement in a simple and quick manner with the triggering device, into the shoot-ready tensioned position, or in other words, the drive device causes the limbs to deform and thereby the energy to be stored in the limbs. The tensioning device may be provided as a fixed part of a crossbow or similar device or may be used as a retrofit device for existing crossbows or similar devices. In the latter case the tensioning device, i.e. the connection element together with the securing devices and the at least one drive device, is connected to the crossbow, in particular to the shaft and the limbs, after the connection between the limbs and the shaft has first been released. Due to the rotatable limbs the crossbow can be transported in an especially space-saving manner, in particular if the limbs rest against the shaft.

According to a preferred embodiment of the invention the securing devices are rotatably or pivotally connected to the connection element. Conveniently the limbs are then fixed, i.e. non-rotatably connected, to the securing devices. For the purpose of a rotatable arrangement the securing devices may each comprise a projection extending away therefrom, such as a spigot or pin, which rotatably engages in one opening each accordingly formed in the connection element. Designs for manufacturing a rotatable or pivotable connection between two bodies, which in terms of the invention constitute the connection element and the securing devices, are known to the expert, wherefore a more detailed description is waived at this point.

It is especially convenient if the at least one drive device is arranged on the rotatable or pivotable securing devices. A direct connection between the drive device and the limbs is thereby avoided, and the tensioning device may be of a very compact and robust design. The drive device thus rotates or pivots the securing devices, to which the limbs are fastened, e.g. fixed under tension.

In case of a crossbow tensioning operation independent of a user's effort, it may be provided, that the drive device is an electrically driven, hydraulically driven, pneumatically driven drive device or a drive device driven by a combination thereof. For example the drive device may be a motor, in particular an electric motor. The drive device is connected to a suitable energy source, for example a battery and for the tensioning operation is generally actuated by the user, whereby the motor is activated or a fluid for example is pressurised.

The physical effort required for tensioning the crossbow can be especially advantageously transferred to the securing devices or the limbs, if the drive device comprises at least one lifting device with a hydraulically, electrically or pneumatically movable reciprocating piston. The drive device is thus designed for a change in its extent between the shaft and the securing devices/the limbs, when the drive device is activated. A lifting device with a reciprocating piston, which when actuated can be extended or displaced is especially suitable for this purpose. Since the securing devices/the limbs are pivotally connected to the shaft, even a minor change in length of the drive device, in particular a small movement of the reciprocating piston, can permit the rotation or pivoting of the limbs from the first position into the second position, as intended for tensioning the crossbow. In the case of a single lifting device for actuating both limbs, connecting devices, e.g. with rods or gears, may be provided in order to translate the translational movement of the reciprocating piston as uniformly as possible onto both limbs.

It is especially convenient if the drive device comprises one hydraulically, electrically or pneumatically driven lifting device each which can be connected to one of the limbs, where the reciprocating piston of the lifting device forms an acute angle, preferably smaller than 60°, especially preferably smaller than 45°, with an imaginary extension of the shaft. The angle may in particular be 20° to 30°. A particularly simple design may be created by providing a lifting device for each of the limbs. In order to design the tensioning device in a manner which achieves a maximum saving in space, the reciprocating piston or another length-variable drive device is arranged at the above mentioned acute angle to the shaft. The acute angle is defined between the reciprocating piston, in particular the direction in which the reciprocating piston moves towards the limbs, and the shooting direction, in which the shaft extends away from the shooter. Due to the acute angle being as small as possible the limb-side end of the lifting device is in addition fastened to the securing device so as to be close to the rotary or pivot axis of the securing device, so that for small changes in the lift, correspondingly large changes in the angle of the limbs can be achieved. In this way the crossbow can be tensioned very quickly, for example within a second or even less. Moreover lifting devices with a small longitudinal extension may be provided, as a result of which the tensioning device can be manufactured even more compact and lighter in weight.

According to a further feature provision is made for the drive device to be designed to move the limbs, following the shooting action, from the second position in direction of the first position, preferably into the first position. The return of the limbs in direction of the non-tensioned first position by means of the drive device makes it easy for the shooter, after he has fired the projectile, to again bring the bowstring into engagement with the triggering device, so that the time needed for this can be shortened. Preferably the return movement can be completed within a second, in particular less than 100 ms. Moreover this operation is performed without any physical effort on the part of the shooter. For example the return can be triggered manually by the shooter. To this end provision may be made for an actuating element to relieve the pressure of a hydraulically, electrically or pneumatically driven lifting device.

The drive device can be designed so that it can be deactivated and to this end can comprise a deactivation device, which can be actuated by the limbs or the bowstring at the end of firing of the projectile, in order to rotate or pivot the tensioned limbs automatically in direction of the first position, preferably into the first position. Due to deactivating the drive device the force exerted by the drive device upon the limbs/the securing devices for tensioning the crossbow is reduced or completely eliminated. This operation does of course not take place until the projectile has been fired and is triggered by the limbs or the bowstring. With this arrangement the position of the limbs or the bowstring can be utilised to actuate the deactivation device. Directly after deactivating the drive device the limbs, due to the tension maintained via the bowstring, can automatically pivot in direction of the shaft without any manual intervention by the shooter. In this way the limbs are returned in very quick time.

Advantageously the drive device can be automatically deactivated in that the deactivation device comprises an actuating element for pressure relief of the hydraulically, electrically or pneumatically driven lifting device. The actuating element is preferably actuated by the bowstring or at least one of the limbs impinging on the actuating element at the end of firing, i.e. when the bowstring or the limbs are in a position as far away as possible from the shooter. The actuating element may be an electric button, after which actuation the pressure or the corresponding force exercised by an electric lifting device upon the limbs is eliminated. In case of a hydraulically or pneumatically driven lifting device the actuating element is preferably a valve which is opened through contact with the bowstring or the limbs.

The automatic return of the limbs into a non-tensioned position after firing can be effected or supported in that the drive device comprises at least one return spring for automatically returning the limbs in direction of the first position, preferably into the first position. In this way the drive device causes both tensioning and relaxing of the crossbow. The return spring may also be in the form of a helical spring, which is received in the lifting device for example.

In order to perform the tensioning as quietly as possible, it is convenient if the drive device is fitted with a sound absorber. This is of advantage in particular if the crossbow is to be used for hunting purposes. For example the drive device may be surrounded, as least partially, by sound-absorbing material.

In order to avoid firing a shot inadvertently and prematurely which might cause injury to persons or animals, the drive device may be connected to a safety element which in turn may be connected to a safety device, wherein the safety device is designed to mechanically fix or release the bowstring in a triggering device connected to the shaft and also to activate or deactivate the drive device, wherein the safety device deactivates the drive device when the safety element is in a deactivation position, activates the drive device and fixes the bowstring when the safety element is in a safety position, and activates the drive device and releases the bowstring for firing a shot when the safety element is in a release position. The safety element may for example be a three-position switch, which is actuated by the shooter. The switch is switched from the deactivation position into the safety position and from this into the release position. This prevents the projectile from being fired before the release position is set. The safety element is connected to the safety device, which on the one hand mechanically fixes the bowstring in the triggering device or releases it therefrom for firing the shot, and on the other hand activates or deactivates the drive device. Deactivation may be effected by interrupting the power supply or the pressure connection to the electrical, pneumatic or hydraulic components of the drive device. In the deactivation position of the safety element, in which the drive device is deactivated, the relaxed bowstring can be brought into engagement with the triggering device and a projectile can be fitted into the crossbow. In the safety position of the safety element the bowstring is fixed in the triggering device and the drive device is activated, i.e. the crossbow is tensioned. In the release position of the safety element the drive device remains activated and the bowstring is released by the triggering device for firing a shot.

In order to ensure that the drive device can be supplied with energy and the shooter is able to comfortably hold the crossbow, it is convenient if for energy supply the drive device comprises an integrated or replaceable compressed-air container or store for electrical energy as a shoulder support. In case of a store for electrical energy, provision is made in particular for at least one battery or at least one accumulator. The compressed-air container or the store for electrical energy may be permanently connected to the crossbow and may comprise ports for recharging with electric energy or compressed air, for example a valve. Alternatively the compressed-air container or the store for electrical energy may be designed so as to be removable from the crossbow, wherein a plug-in connection or screw connection is then convenient for releasably attaching the energy store to the crossbow. It is especially convenient if the energy store is positioned such that it serves as a shoulder support for the shooter, similar to the butt of a rifle.

The requirement according to the invention is also met by an above-mentioned crossbow, on which an above-described tensioning device is arranged on the shaft. The crossbow comprises, in a manner known as such, a shaft extending in shooting direction for, among others, receiving a projectile such as an arrow or a roundball made of steel for example. The crossbow also comprises two limbs rotatably or pivotally connected to the shaft, to which limbs a bowstring provided for engaging in the projectile is fastened. According to the invention the crossbow is connected to the tensioning device, wherein the connection may be of fixed or detachable design so as to enable the tensioning device to be detached from the shaft of the crossbow. In case of a detachable connection the tensioning device can be fitted as a retrofit-set to an existing crossbow.

In order to aid the shooter in reloading the crossbow with projectiles it can be advantageous to arrange a magazine for projectiles, in particular arrows on the shaft.

The invention will now be described in further detail by way of preferred, non-restricting embodiments with reference to the drawings, in which FIG. 1 shows a tensioned crossbow with a tensioning device according to the invention;

Figure 1:
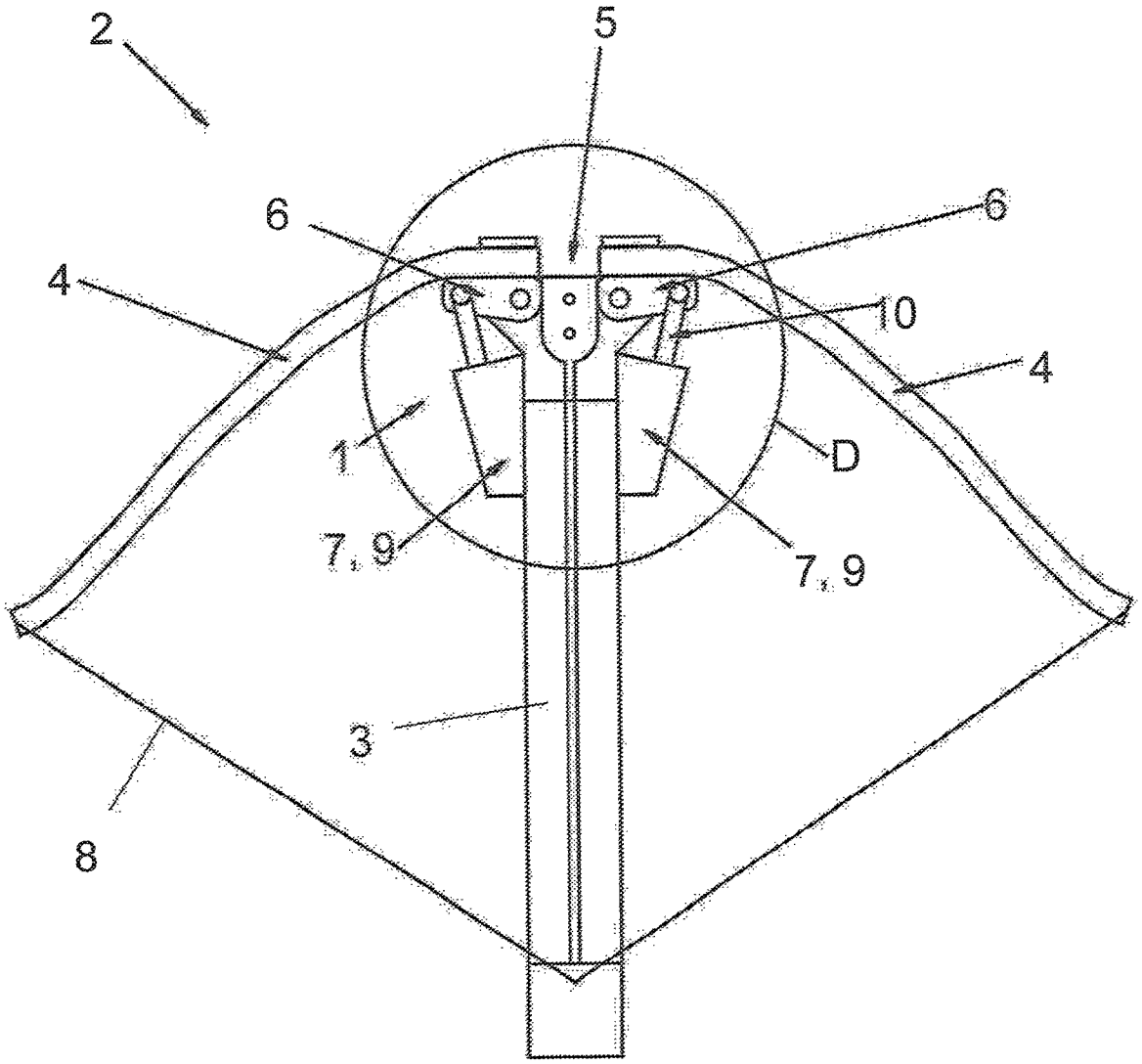

FIG. 1 shows a crossbow 2 in a tensioned state, with a shaft 3 and limbs 4 connected thereto, and with a tensioning device 1 according to the invention. The tensioning device 1 may be designed as a retrofit device for crossbows 2 or similar devices such as harpoons, line throwing devices, toy crossbows, pistol crossbows, spear throwers (ballistas) or be integrated in crossbows or similar devices. The tensioning device 1 comprises a connection element 5, which is designed for connecting, for example screwing it in a stable and possibly detachable manner to the shaft 3 of the crossbow 2. The connection element 5 has two securing devices 6 (attachment devices 6), that is one each per limb 4 arranged thereon, with which securing devices 6 the limbs 4 are rotatably or pivotally attached to the crossbow 2. In the exemplary embodiments shown the securing devices 6 are rotatably or pivotally connected to the connection element 5 by means of pins B1 about an axis of rotation A1 (see FIG. 2A). The limbs 4 are firmly connected, for example screwed or clamped, to the securing devices 6. Furthermore the connection element 5 is connected to two drive devices 7, which are for example by means of pins B2 also connected so as to be rotatable about an axis of rotation A2, to the rotatable or pivotal securing devices 6. The drive devices 7 rotate or pivot the limbs 4 from a first position P1, in which the limbs 4 enclose a first angle $\alpha 1$ together with the shaft 3, into a second position P2, in which the limbs 4 enclose a second angle $\alpha 2$ together with the shaft 3.

Figure 2:
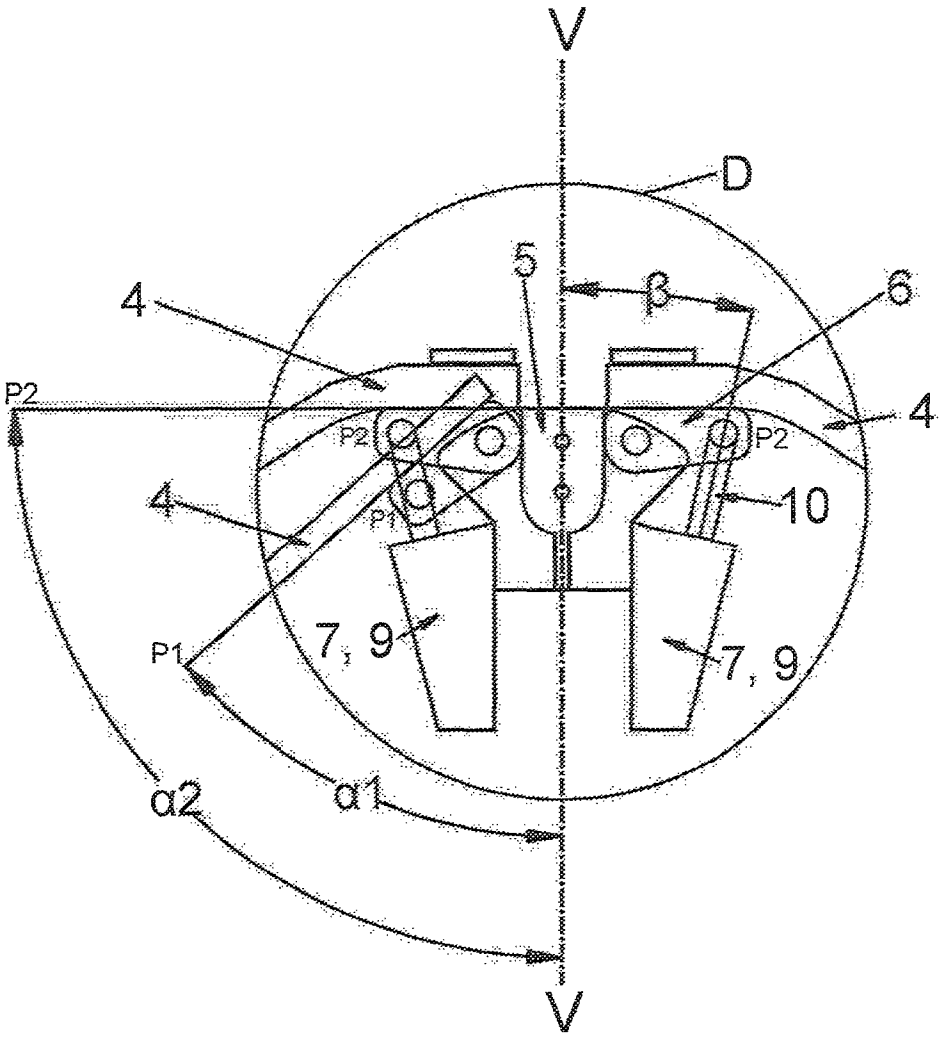
FIG. 2 shows a detail view of the tensioning device of the crossbow as per FIG. 1.
Figure 2A:
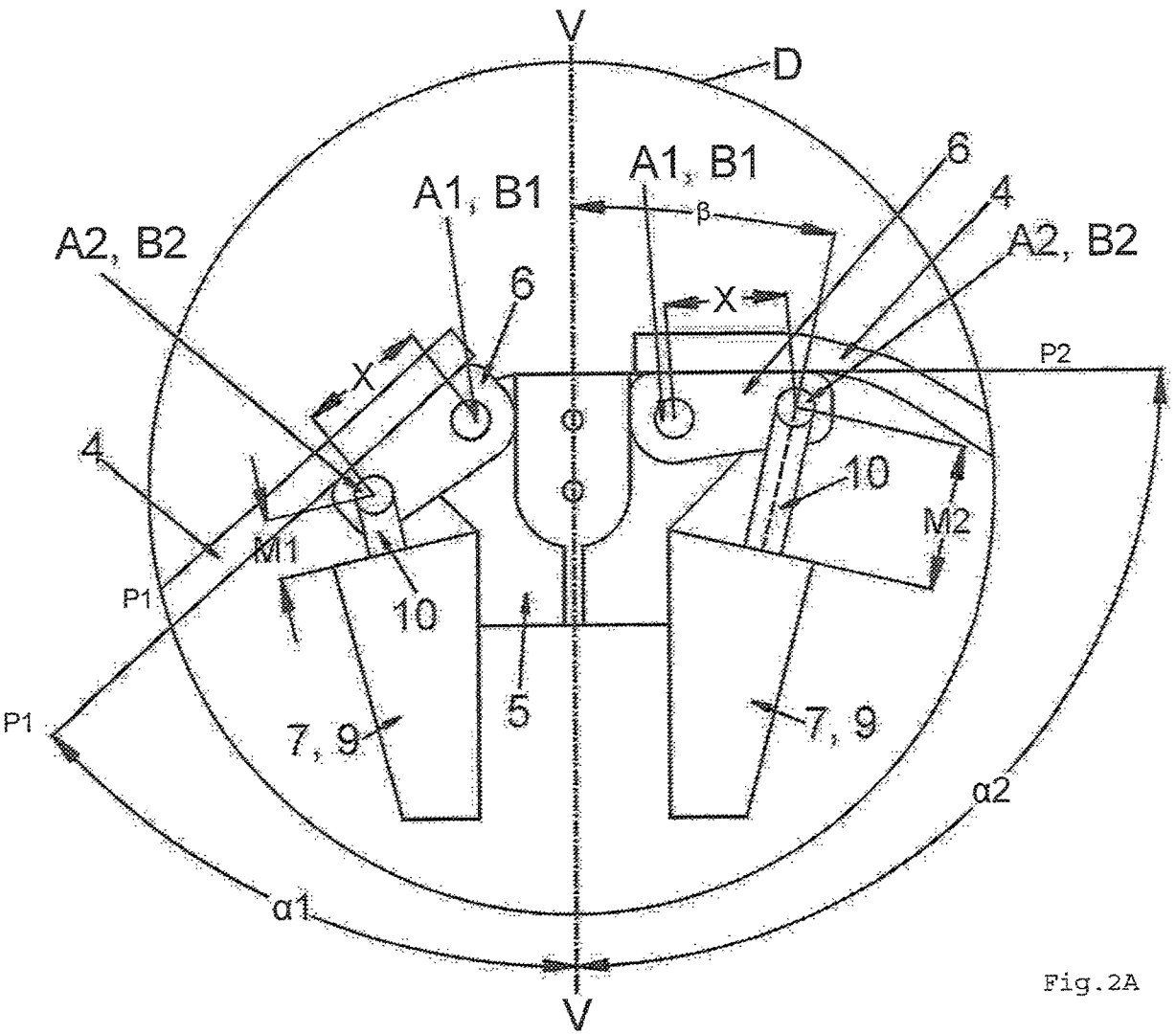
FIG. 2A shows the detail view from FIG. 2, merely for the purpose of gaining understanding, with a tensioned and a relaxed limb.

The positions P1 and P2 as well as the first angle $\alpha 1$ and the second angle $\alpha 2$ are to be seen in particular in the detail views in FIGS. 2 and 2A, which show an enlarged view of detail D in FIG. 1. The first position P1 corresponds to a relaxed position of the limbs 4, in which the bowstring 8 connected to the limbs 4 can be fixed quickly and without a great deal of effort by the shooter in a triggering device 19 arranged on the shaft 3. By contrast the second position P2 corresponds to a tensioned position of the limbs 4, wherein the bowstring 8 is also tensioned. Accordingly the second angle $\alpha 2$ is larger than the first angle $\alpha 1$. For better understanding a relaxed position P1 of the left limb 4 is shown in FIG. 2 as a broken line. FIG. 2A, also for the purpose of better understanding, shows a left limb 4 in the first position P1 and a right limb 4 in the second position P2. In fact the tensioning device 1 is designed to pivot both limbs 4 symmetrically to the shaft 3.

In FIGS. 1, 2 and 2A each of the drive devices 7 comprises a lifting device 9 with a hydraulically, electrically or pneumatically displaceable reciprocating piston 10. The reciprocating piston 10 can be moved out of the lifting device 9 as shown in the right-hand part of FIG. 2A and can be moved back into the lifting device 9, as depicted in the left-hand part of FIG. 2A. In particular each lifting device 9/each reciprocating piston 10 is arranged at an acute angle ß relative to an imagined extension V of the shaft 3, so that the pins B2 or their axes of rotation A2 are arranged particularly close to the pins B1/their axes of rotation A1 on the securing devices 6. In this way a small change in lift, which is defined as the difference between the lift H1 of the retracted reciprocating piston 10 and the lift H2 of the extended reciprocating piston 10, can cause a large difference between angle $\alpha 1$ and angle $\alpha 2$. The crossbow 2 can thus be tensioned in a particularly quick manner. The acute angle ß is preferably smaller than 60°, in particular smaller than 45°. The distance X between the pins B1 and B2/between axes of rotation A1 and A2 may be smaller than the change in lift (H2–H1).

Figure 3:
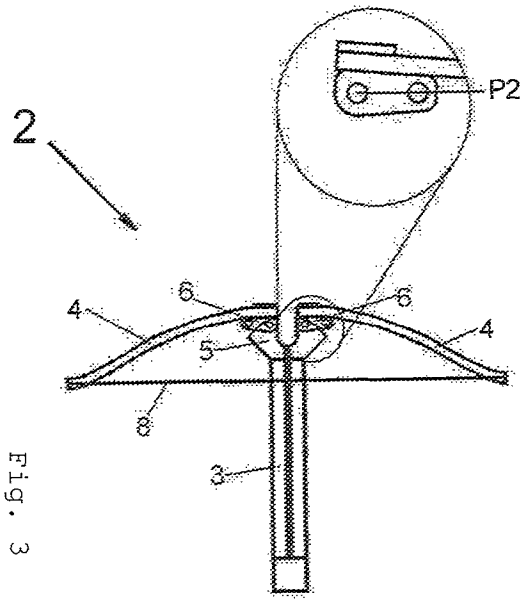
FIG. 3 shows the crossbow as per FIG. 1 directly after firing a shot.
Figure 4:
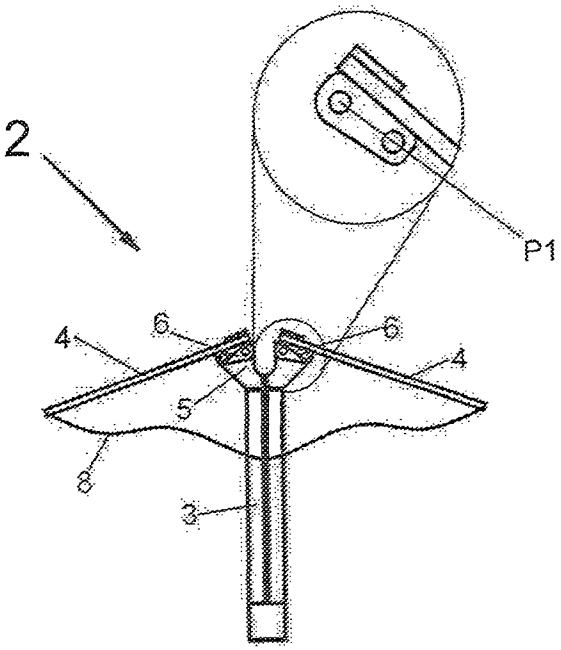
FIG. 4 shows the crossbow as per FIG. 1 after firing a shot with already relaxed limbs.
Figure 5:
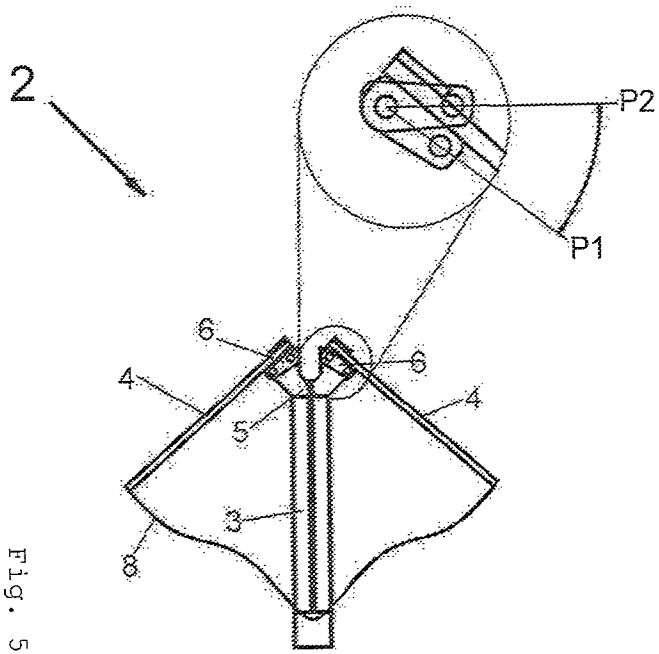
FIG. 5 shows the crossbow as per FIG. 1 after firing a shot with relaxed limbs and a bowstring connected to a triggering device.
Figure 6:
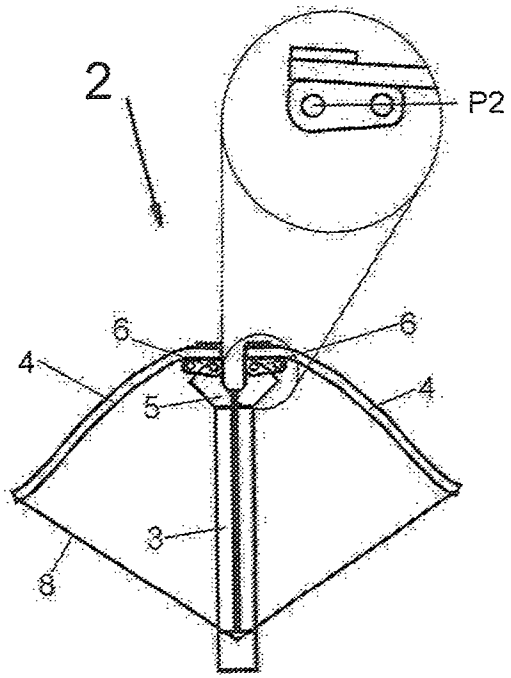
FIG. 6 shows the crossbow as per FIG. 1 in a tensioned state prior to firing a shot.

FIGS. 3 to 6 show four different states of the crossbow 2. In FIG. 3 the crossbow 2 is depicted directly following firing a shot, wherein the limbs 4 and the bowstring 8 are still tensioned, i.e. the limbs 4 are still in the second tensioned position P2. FIG. 4 shows the crossbow 2 after firing a shot with limbs 4 already partially pivoted, so that these and the bowstring 8 are relaxed. In FIG. 5 the crossbow 2 is depicted after firing a shot with relaxed limbs 4 and a relaxed bowstring 8, wherein the bowstring 8 is already in engagement with a triggering device 19 designed in a manner known as such, in order to mechanically fix or release the bowstring 8. In this state the limbs 4 are pivoted into the first position P1. FIG. 6 finally shows the crossbow 2 in a tensioned state prior to firing a shot, i.e. the bowstring 8 is still fixed by the triggering device 19 and the limbs 4 are again pivoted into the second position 2.

Figure 7:
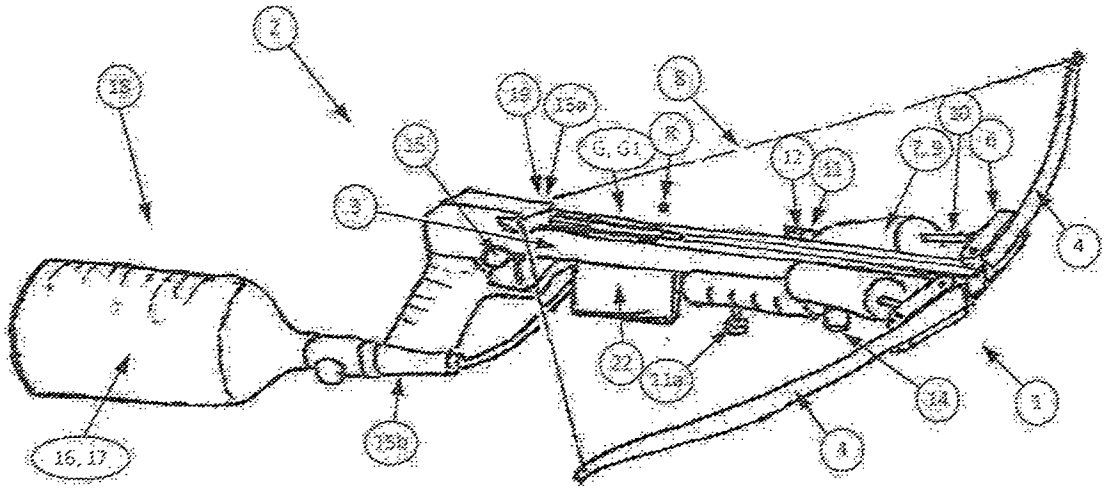
FIG. 7 shows a perspective view of a crossbow according to the invention.

FIG. 7 shows a crossbow 2 in a perspective view with a deactivation device 11, for deactivating the drive device 7, in order to thereby cancel the force exerted by the drive device 7 upon the limbs 4 and to rotate the still temporarily tensioned limbs 4 automatically in direction of the first position P1/into the first position P1. The deactivation device 11 is triggered either by the limbs 4 or the bowstring 8 at the end of firing a shot, or by the shooter by means of a manual actuating element 11*a*. The deactivation device 11 for example comprises an actuating element 12 for relieving pressure on the hydraulically, electrically or pneumatically driven lifting device 9, which actuating element 12 is hit by the bowstring 8 at the end of firing a shot. The actuating element 12 may be realised by a valve, which may be provided for relieving pressure from a pneumatically driven lifting device 9. Also depicted in FIG. 7 is an integrated or replaceable compressed air container 16 or store for electrical energy 17 for supplying the drive device 7 depicted as a shoulder support 18 with energy, as well as a sound absorber 14 on the drive device 7. FIG. 7 also shows a safety element 15 which is connected to the drive device 7 via a safety device 15*b* The safety device 15*b* is designed to mechanically fix/release the bowstring 8 in/from the triggering device 19 and to activate or deactivate the drive device 7. A magazine 22 for projectiles G, in particular for arrows G1 or roundballs R, is arranged on the shaft 3.

Figure 8A:
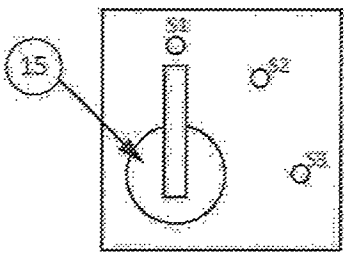
FIGS. 8A to 8C show a safety element for a drive device for a crossbow in three different positions.
Figure 8B:
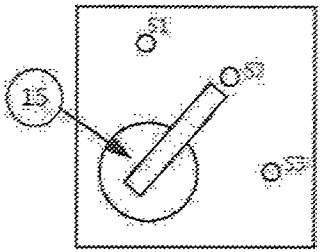
Figure 8C:
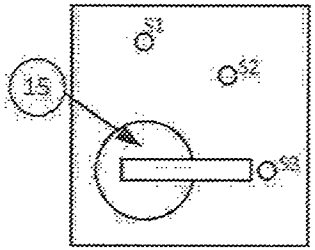

FIGS. 8A to 8C show the safety element 15 in three different positions, wherein in the deactivation position S1 of safety element 15 depicted in FIG. 8A, the drive device 7 is deactivated by the safety device 15*b*, in the safety position S2 of the safety element 15 depicted in FIG. 8B, the drive device 7 is activated by the safety device 15*b* and the bowstring 8 is fixed in the triggering device 19, and wherein in the release position S3 of the safety element 15 depicted in FIG. 8C the drive device 7 is still activated by the safety device 15*b* and the bowstring 8 is released by the triggering device 19 for firing a shot.

Figure 9:
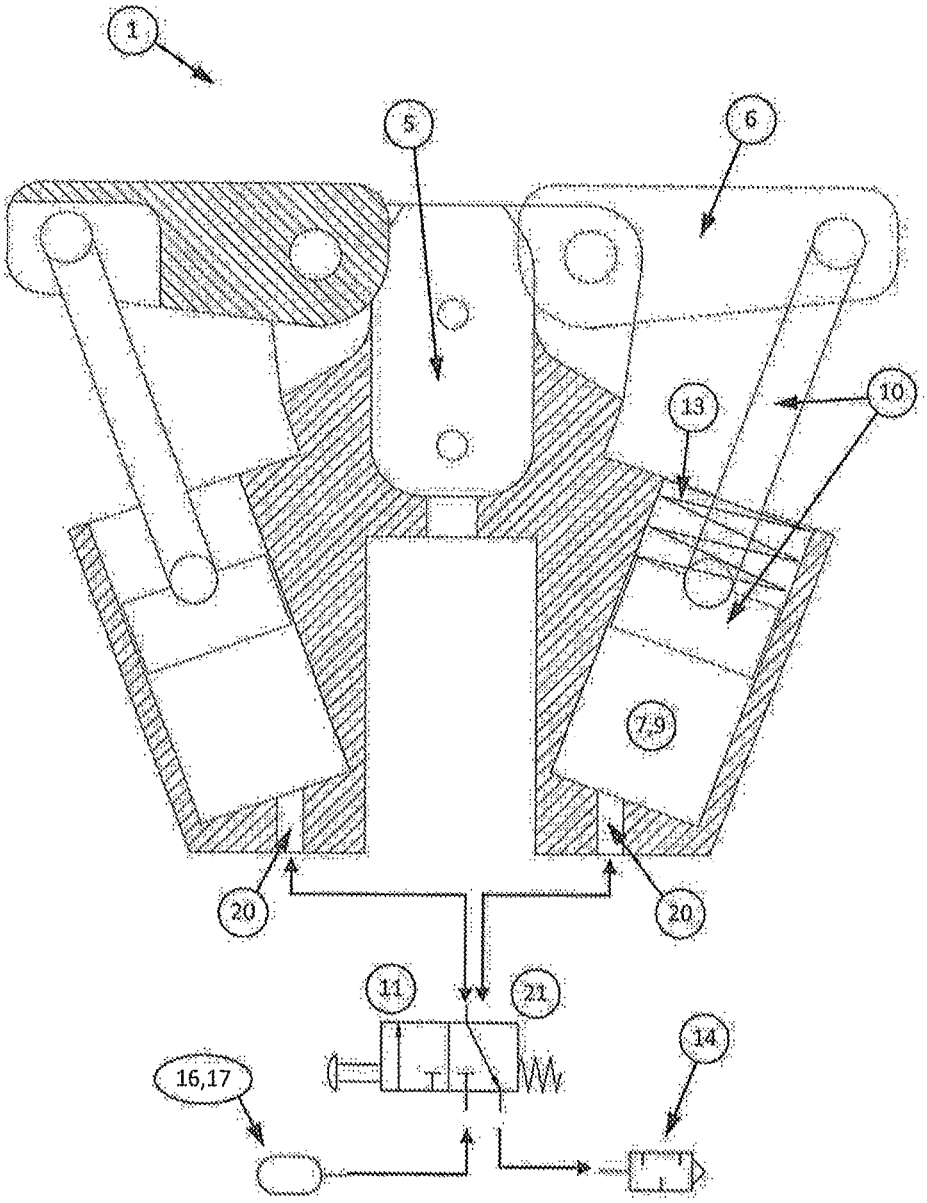
FIG. 9 shows a schematic view of a tensioning device for a crossbow according to the invention.

FIG. 9 shows a schematic sectional view of a tensioning device 1 for a crossbow 2, with a return spring 13 as part of the drive device 7 for automatically returning the reciprocating piston 10/the limbs 4 (not shown) mounted via the securing device 6 in direction of the first position P1/into the first position P1. Moreover fluid channels 20 connected to the drive device 7, in particular to the lifting device 9 are provided for supplying and discharging compressed air or a hydraulic liquid. Furthermore provision is made for a compressed-air container 16 and a shuttle valve 21, which functions as a drain valve and an inlet valve. The drive device 7 can be deactivated via the deactivation device 11 at the end of firing a shot. As schematically shown a sound absorber 14 may be provided. In the case of an electrically driven drive device 7 a store for electrical energy 17, in particular a battery (not shown) may be provided instead of the compressed-air container 16.

The invention claimed is:

1. A tensioning device for a device with a shaft and limbs connected thereto, wherein a connection element is provided which is designed for connection to the shaft of the device crossbow and which comprises securing devices for rotatably or pivotally connecting the limbs, wherein the connection element is connected to at least one drive device, which can be connected to the limbs and by means of which drive device the limbs can be rotatably or pivotally moved from a first position, in which the limbs form a first angle together with the shaft, into a second position, in which the limbs form a second angle together with the shaft, wherein the second angle is larger than the first angle in order to move the limbs and a bowstring connected thereto from a non-tensioned position into a shoot-ready tensioned position.

2. The tensioning device according to claim 1, wherein the securing devices are rotatably or pivotally connected to the connection element.

3. The tensioning device according to claim 2, wherein the at least one drive device is arranged on the rotatable or pivotal securing devices.

4. The tensioning device according to claim 1, wherein the drive device is an electrically driven, hydraulic driven, pneumatically driven drive device or a drive device driven by a combination of these.

5. The tensioning device according to claim 4, wherein for energy supply the drive device comprises an integrated or replaceable compressed-air container or store for electrical energy as a shoulder support.

6. The tensioning device according to claim 1, wherein the drive device comprises at least one lifting device with a hydraulically, electrically or pneumatically displaceable reciprocating piston.

7. The tensioning device according to claim 6, wherein the drive device respectively comprises a hydraulically, electrically or pneumatically driven lifting device which can be connected to a limb, the reciprocating piston of which lifting device forms an acute angle with an imagined extension of the shaft.

8. The tensioning device according to claim 1, wherein the drive device is designed to move the limbs, following firing a shot, from the second position in a direction of the first position.

9. The tensioning device according to claim 8, wherein the drive device is designed to be deactivatable and for deactivation comprises a deactivation device, which can be actuated by the limbs or the bowstring at the end of firing a shot, in order to rotate or pivot the tensioned limbs automatically in a direction of the first position.

10. The tensioning device according to claim 9, wherein the deactivation device comprises an actuating element for relieving pressure on the hydraulically, electrically or pneumatically driven lifting device.

11. The tensioning device according to claim 8, wherein the drive device comprises at least one return spring for an automatic return of the limbs in a direction of the first position.

12. The tensioning device according to claim 1, wherein the drive device is fitted with a sound absorber.

13. The tensioning device according to claim 1, wherein the drive device is connected to a safety element and this is connected to a safety device, which safety device is designed both to mechanically fix or to release the bowstring in/from a triggering device connected to the shaft as well as to activate or deactivate the drive device, wherein the safety device, in a deactivation position of the safety element, deactivates the drive device, in a safety position of the safety element activates the drive device and fixes the bowstring, and in a release position of the safety element, activates the drive device and releases the bowstring for firing a shot.

14. A crossbow with a shaft extending in a shooting direction for receiving a projectile, and with two limbs rotatably or pivotally connected to the shaft, to which limbs a bowstring provided for engaging in the projectile is attached, wherein the tensioning device according to claim 1 is arranged on the shaft.

15. The crossbow according to claim 14, wherein a magazine for projectiles is arranged on the shaft.

* * * * *